United States Patent [19]

Camus

[11] 3,983,673

[45] Oct. 5, 1976

[54] VOLUMIC CONSTRUCTION ELEMENT OF GENERALLY RECTANGULAR PARALLELEPIPED SHAPE

[76] Inventor: Raymond Francois Emile Camus, 27, avenue Foch, 75016 Paris, France

[22] Filed: Mar. 14, 1975

[21] Appl. No.: 558,551

Related U.S. Application Data

[63] Continuation-in-part of Ser. No. 374,055, June 27, 1973, abandoned.

[30] Foreign Application Priority Data

July 4, 1972 France ..... 72.24118

[52] U.S. Cl. ..... 52/263; 52/79; 52/601

[51] Int. Cl.[2] ..... E04B 5/16

[58] Field of Search ..... 52/236, 583, 602, 263, 52/601, 79, 745, 583

[56] References Cited

UNITED STATES PATENTS

| | | | |
|---|---|---|---|
| 1,031,043 | 7/1912 | Conzelman | 52/583 |
| 1,796,048 | 3/1931 | Robinson | 52/601 |
| 3,028,707 | 4/1962 | Sagalovitch | 52/745 |
| 3,279,135 | 10/1966 | Jacobsen | 52/583 |
| 3,378,971 | 4/1968 | Singer | 52/263 |
| 3,500,595 | 3/1970 | Bennett | 52/236 |
| 3,712,007 | 1/1973 | Kump | 52/236 |
| 3,733,762 | 5/1973 | Pardo | 52/263 |
| 3,834,095 | 9/1974 | Ohlson | 52/236 |

FOREIGN PATENTS OR APPLICATIONS

| | | | |
|---|---|---|---|
| 106,244 | 1/1967 | Denmark | 52/79 |
| 1,299,838 | 7/1969 | Germany | 52/236 |
| 6,902,326 | 8/1970 | Netherlands | 52/236 |
| 107,061 | 9/1965 | Norway | 52/745 |

*Primary Examiner*—Price C. Faw, Jr.
*Assistant Examiner*—Henry Raduazo
*Attorney, Agent, or Firm*—Burgess Ryan and Wayne

[57] ABSTRACT

A construction unit of generally rectangular parallelepiped shape, comprising a rectangular slab of reinforced concrete with a peripheral rib and square cross-section metallic tubular columns welded to the corners of the slab on metallic brackets thereon, the outer faces of the columns being an extension of the outer faces of the slab and, the columns having free extremities. A multi-story building is formed by juxtaposing and stacking units, with the juxtaposed elements of each story being interconnected by their adjacent metallic columns.

17 Claims, 14 Drawing Figures

VOLUMIC CONSTRUCTION ELEMENT OF GENERALLY RECTANGULAR PARALLELEPIPED SHAPE

This application is a continuation-in-part of copending application Ser. No. 374,055, filed June 27, 1973 and now abandoned.

The present invention relates to a 3-dimensional construction unit and to a building structure using such units.

It has been proposed to manufacture construction units in the factory which can be assembled on the site to construct a building.

These construction units, whose maximum dimensions are governed by transport possibilities, are generally composed of hollow bodies bounded by concrete panels or columns. Most of these units are extremely heavy and difficult to transport. In addition, it is difficult to construct multi-story buildings using these units, since they are either extremely heavy or else their horizontal wind load or seismic stress ratings are very limited.

The building according to the invention is based on a totally different concept, and makes use, in order to have the building withstand any horizontal stresses applied to its frontage, not in the individual resistance of each element but in bracing obtained by assembling said elements. The construction is designed so as to ensure that the horizontal stresses are distributed to vertical structures spaced apart in the building, according to a technique similar to that used in metallic buildings or constructions.

The form of the construction unit according to the invention is thus different from that of known construction units. It is basically comprised of a lower slab of reinforced concrete, which is generally rectangular. Square tubular metallic columns are attached to the corners of the slab. The columns have a relatively small cross section which is sufficient to withstand the vertical stresses from the upper units, but not to withstand the horizontal component stresses. Vertical panels are interposed between the columns to complete the unit. The top portion of the unit is open. The panels are generally suitable for withstanding only the horizontal stresses directly applied to them, for example as a result of wind.

Thus, these vertical panels do not play a basic part in distributing the horizontal stresses applied to the other units. However, the lower or floor slabs, owing to their interconnections, constitute a horizontal wind bracing plane that is capable of transmitting all the horizontal stresses applied to each story to vertical bracing structures, or piles, placed either opposite or along partitions or along gables. The unit as a whole may thus be relatively light and cheap.

The present invention contemplates an embodiment of this unit in which the reinforced concrete slab has abutting transverse ribs suitable for transmitting the horizontal tensile and compressive stresses. Metal columns are made integral with the units, advantageously by simply welding a metallic cladding on the corners of the slab. This enables the interconnecting of different juxtaposed units, advantageously by simply welding onto a metallic cladding of the corners of the slab. It is also possible, by joining together different juxtaposed units, between the adjacent columns, to form the beams of a horizontal wind bracing structure that is as strong as if it were constituted by a single slab whose dimensions could not, however, enable it to be transported from a factory to the site on which the building is erected.

In a further embodiment of the invention, the slab also has a median transverse rib, and means for welding the transverse rib to adjacent slabs. The transmission of the shearing strains obtained by these junctions enables the 3-dimensional units to be correctly assembled.

In the following description, given by way of example, reference is made to the attached drawings, wherein.

Figure 1:
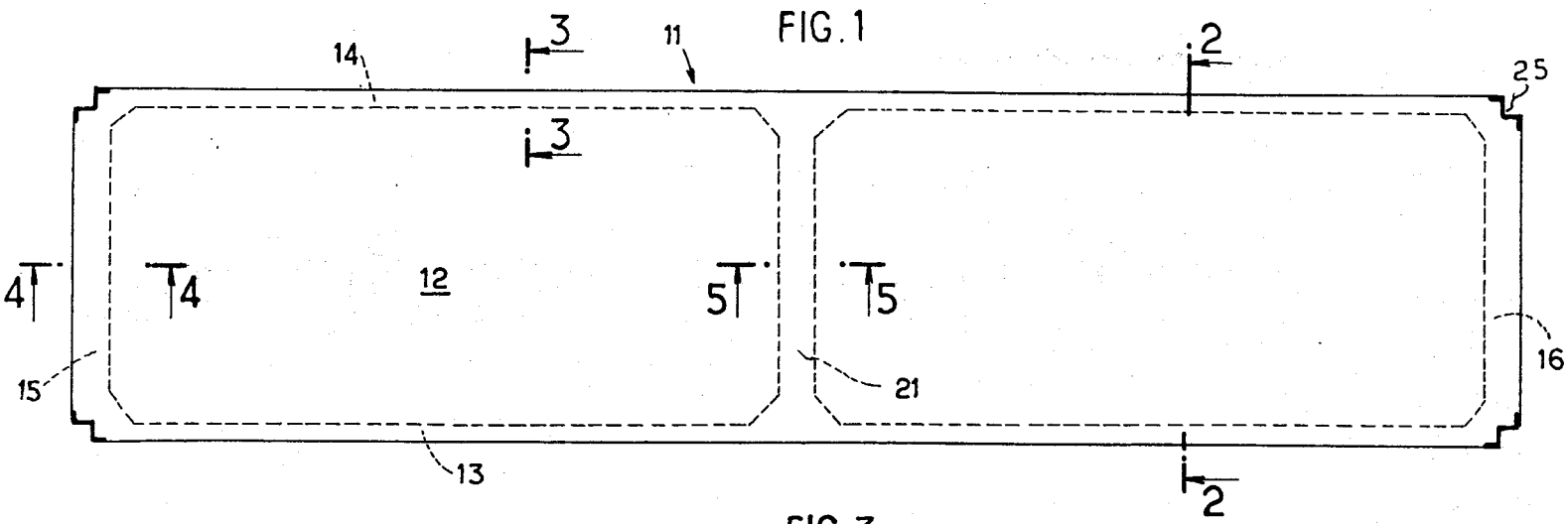
FIG. 1 is a top view of a slab forming part of the unit according to the invention.
Figure 5:
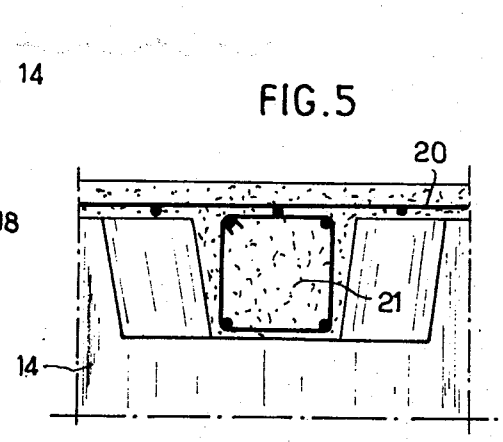
FIG. 5 is an enlarged cross-section view along line 5—5 of FIG. 1.
Figure 3:
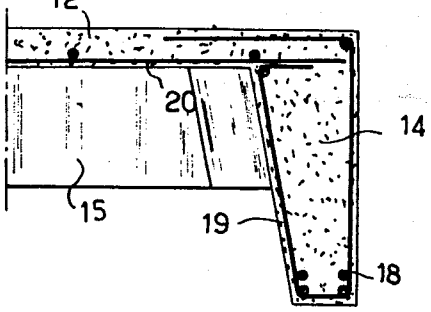
FIG. 3 is an enlarged cross-section along line 3—3 of FIG. 1.
Figure 4:
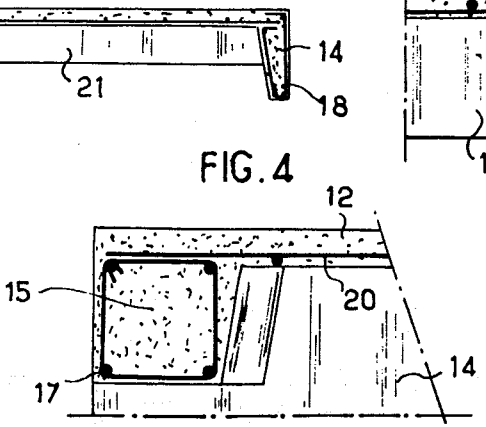
FIG. 4 is an enlarged cross-section line 4—4 of FIG. 1.
Figure 2:
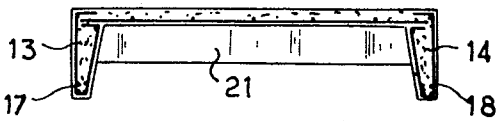
FIG. 2 is a cross-section along line 2—2 of FIG. 1.

Referring to FIG. 1, the units according to the invention are each comprised of a slab 11 of reinforced concrete, which includes a relatively thin flat slab body 12, bordered by longitudinal ribs 13 and 14 and transverse ribs 15 and 16, the ribs 13 – 16 thus constituting a continuous belt around the slab. The ribs have reinforcing armatures as represented at 17, 18 (FIG. 2) and reinforcing straps 19 (FIG. 3), and the body 12 containing reinforcements 20. The longitudinal ribs 13, 14, in one embodiment, are higher than the transverse ribs 15 and 16. The slab further comprises a median transverse rib 21 which may be of the same height as the transverse ribs 15 and 16. In an alternative embodiment, the longitudinal and transverse ribs may be of the same height.

The slab is generally rectangular and can, for example, have a longitudinal dimension in the order of 9.60 m and a transverse dimension in the order of 2.40 m, the height of the longitudinal ribs being 46 cm and the height of the transverse ribs 15 and 16 of the median and rib being 20 cm. These dimensions are of course exemplary only, and are not intended to limit the scope of the invention.

Figure 6:
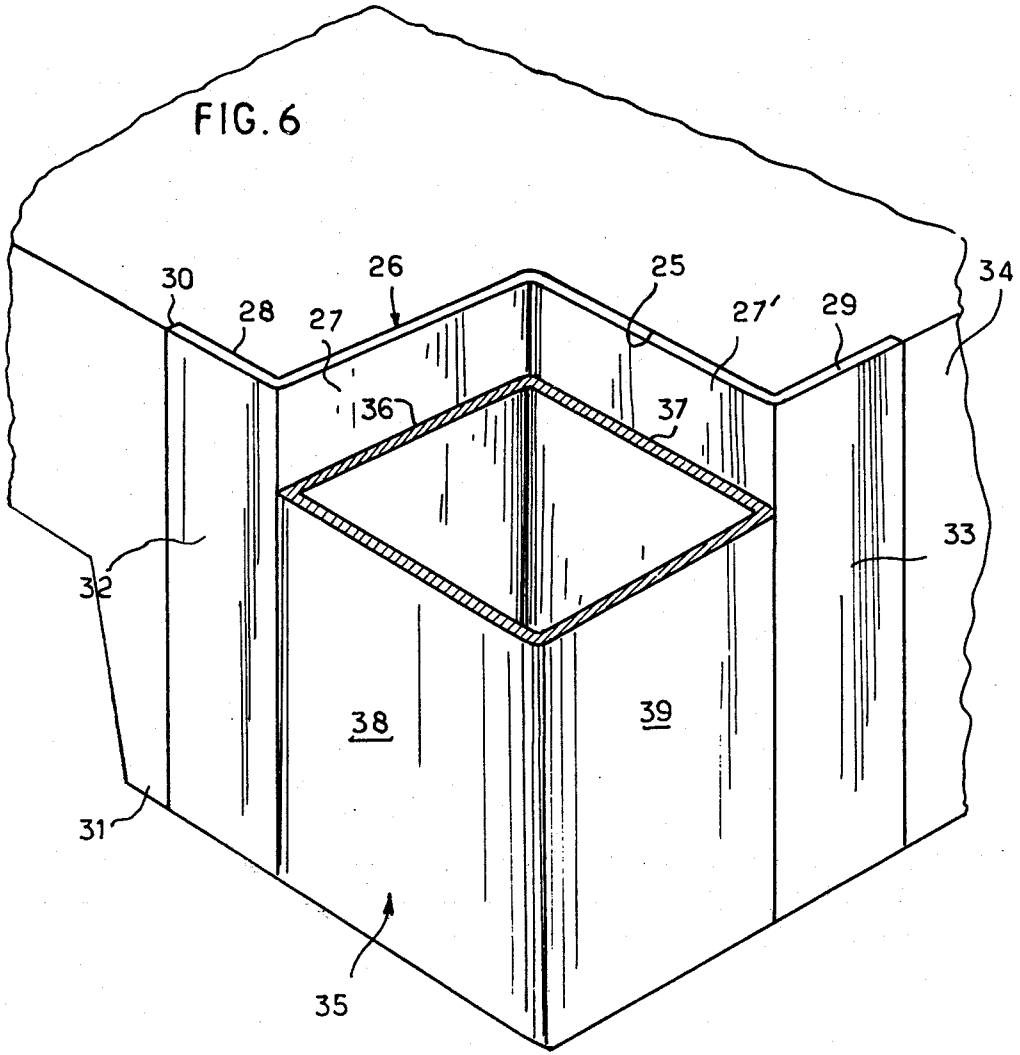
FIG. 6 is a perspective view on an even larger scale, of a corner of a slab of FIG. 1 fitted with a column.
Figure 8:
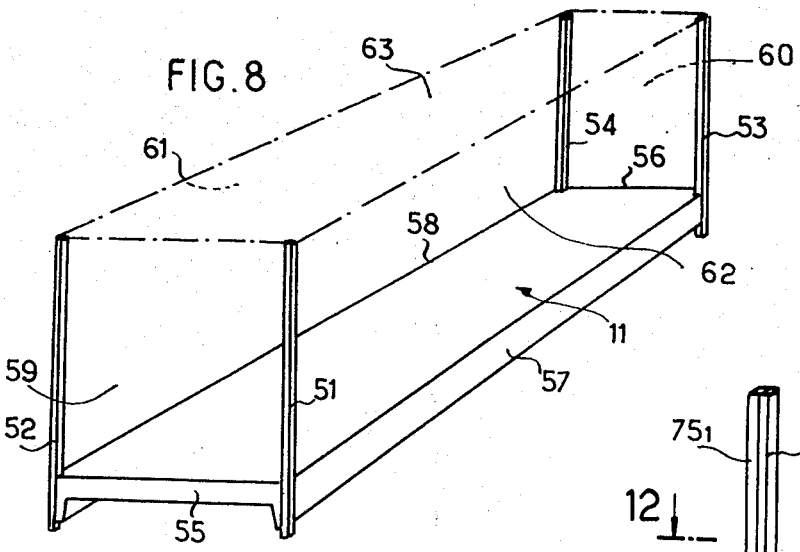
FIG. 8 is a perspective diagram of a three-dimensional unit.

At each of its corners, the slab has a cut-out or notch 25 (FIG. 6) shaped to house a metallic bracket 26. The bracket, which is of the same height as the adjoining peripheral ribs, has two rectangular arms 27 and 27' and extending therefrom two perpendicular wings 28 and 29, respectively. Wing 28 is housed in a recess 30 in face 31 of the rib, so that the outer metallic surface 32 forms an extension of concrete surface 31. Similarly, outer surface 33 of wing 29 forms an extension of concrete surface 34 of the slab and the adjoining transverse rib. If the longitudinal and transverse ribs have different heights, the height of the bracket is varied to conform to the height of the adjoining rib portion.

A steel square cross-section tubular column 35 with a wall thickness in the order, for example, of 4 mm is housed in cut-out 25, with face 36 of the column lying against arm 27 and the adjacent face 37 lying against arm 27' of the metallic bracket. The width of each of the column faces is in the order, for example, of 10 cm. Outer face 38 of the column, adjacent to face 36 forms an extension of and is coplanar with surface 32 of wing 28 and the fourth face 39 of the column forms an extension of and is coplanar with surface 33 of wing 29. The contour of the complete unit thus exactly matches that of a rectangular slab not provided with cut-outs. The bottom of the column is even with the bottom of the longitudinal ribs.

The column is made integral with the slab by welding together, on the one hand, face 36 of the column and arm 27'. The width of the weld, which runs all the way up the bracket, at the junctions of the arms 27, 27' and wings 32, 33 respectively, may be in the order of a few millimeters.

Figure 7:
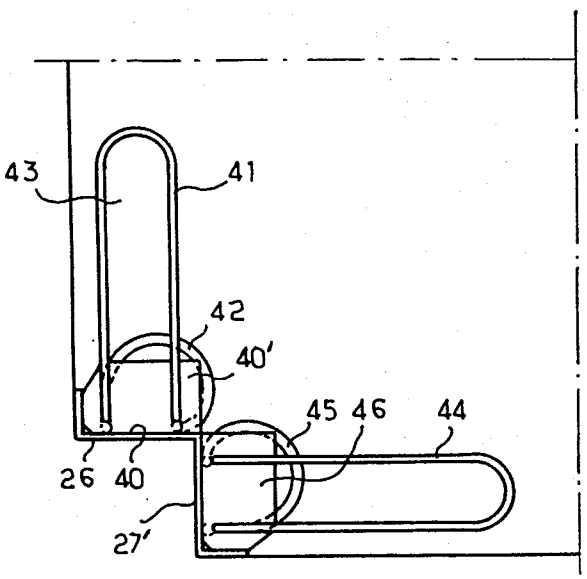
FIG. 7 is a top view of an angle bracket provided with anchoring means.

As shown in FIG. 7, one or more round steel anchorings 41, 42 embedded within the concrete 43 of rib 15 can be attached advantageously by means of a gusset plate 40' to the inner face 40 of an arm 27 and thus secure the bracket to the concrete. Arm 27' is also advantageously provided with such an attachment means, formed by anchorings 44 and 45 welded to a gusset plate 46 which is itself welded to arm 27' of bracket 26.

A 3-dimensional unit according to the invention thus includes a rectangular reinforced concrete slab 11, at the corners of which are erected tubular columns 51, 52, 53 and 54 having relatively small cross-sections. The columns do not project in relation to the outer faces 55, 56, 57 and 58 of the slab. Light panels 59, 60 and 61, 62 may be disposed between the columns if desired, and if need be, the upper portion of the unit may include a horizontal panel 63 functioning as a false ceiling.

Such a 3-dimensional unit is relatively light and is so dimensioned as to enable it to be transported by a standard size road vehicle.

Figure 9:
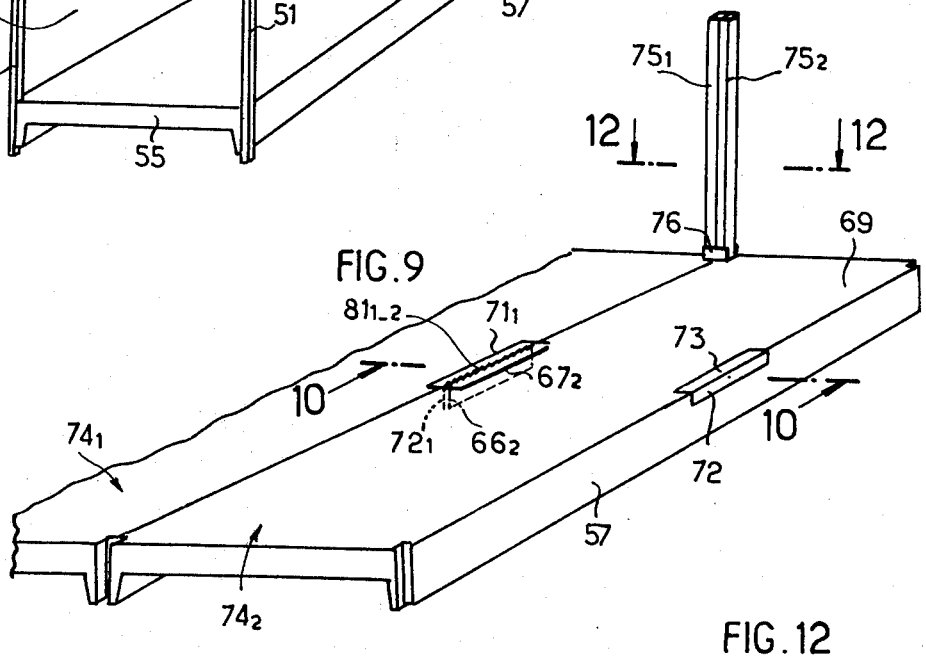
FIG. 9 is a perspective view of two adjacent slabs with assembly means.
Figure 10:
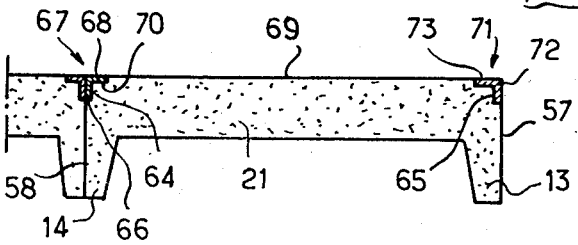
FIG. 10 is a cross-section along line 10—10 of FIG. 9.

In the embodiment represented in FIG. 9, the upper portions of longitudinal vertical faces 58 and 57 of the slab have recesses 64 and 65, respectively, (FIG. 10) opposite transverse rib 21, for housing an arm 66 of an angle iron 67. The other arm 68 of angle iron 67 is flush with the upper horizontal face 69 of the slab, since it is fitted in a recess 70 provided in the face 69. Similarly, face 57 of the slab is provided with an angle iron 71, the outer face of wing 72 thereof is flush with said face 57 and the upper face of the other wing 73 whereof is flush with the upper face 69 of the slab.

Figure 11:
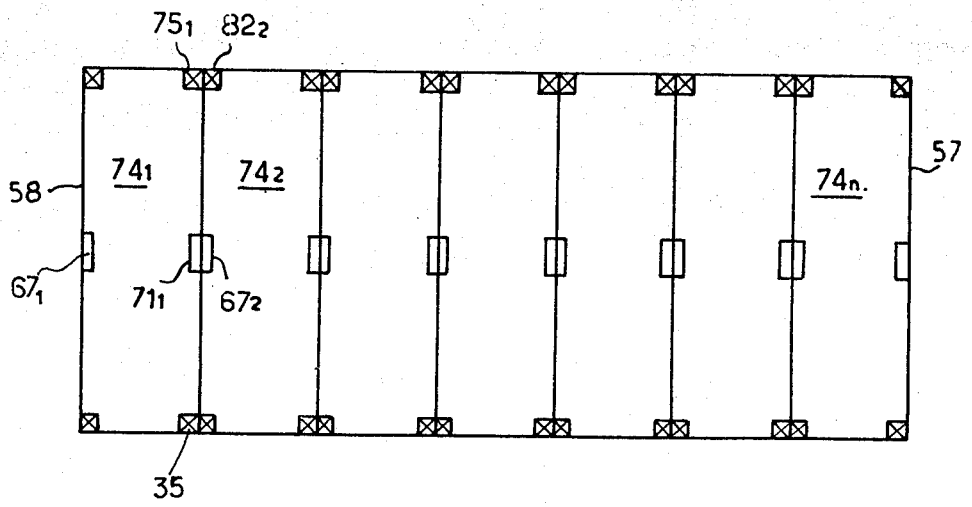
FIG. 11 is a diagrammatic top view of assembled units.

In order to form the floor of a building, a determined number of units are placed side by side. FIG. 11 thus shows units 74-1, 74-2 . . . **74-*n* whose slabs 11 are juxtaposed along their longitudinal faces 57, 58.**

Figure 12:
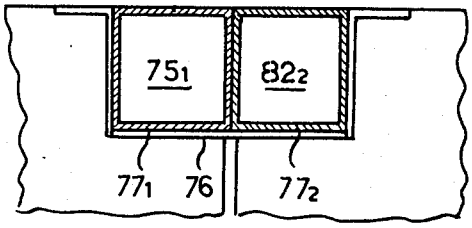
FIG. 12 is a horizontal cross-section of two portions of adjacent slabs showing their interconnection by way of their columns.

The adjacent columns 75-1, 72-2 (FIG. 12) of two neighboring slabs are interconnected at their bases by a plate 76 welded to the inner transverse faces 77-1, 77-2 of the columns. All the columns adjacent to the units are interconnected in this way.

In addition, the adjacent units are interconnected by their adjacent median angle irons. Thus, FIG. 9 shows a weld seam 81-1-2 joining wing 72-1 of angle iron 71-1 of element 74-1 to wing 66-2 of angle iron 67-2 of element 74-2.

The horizontal stresses to which the units are subjected, when the construction has been completed, are transmitted by the ribs of the slabs, and plates 76 are suitable for withstanding the tensile and compressive stresses that may be applied parallel to the transverse ribs. Shearing strains tending to cause the slabs to slide longitudinally against one another are withstood without any difficulty by the adjacent welded angle irons 67–71.

Figure 13:
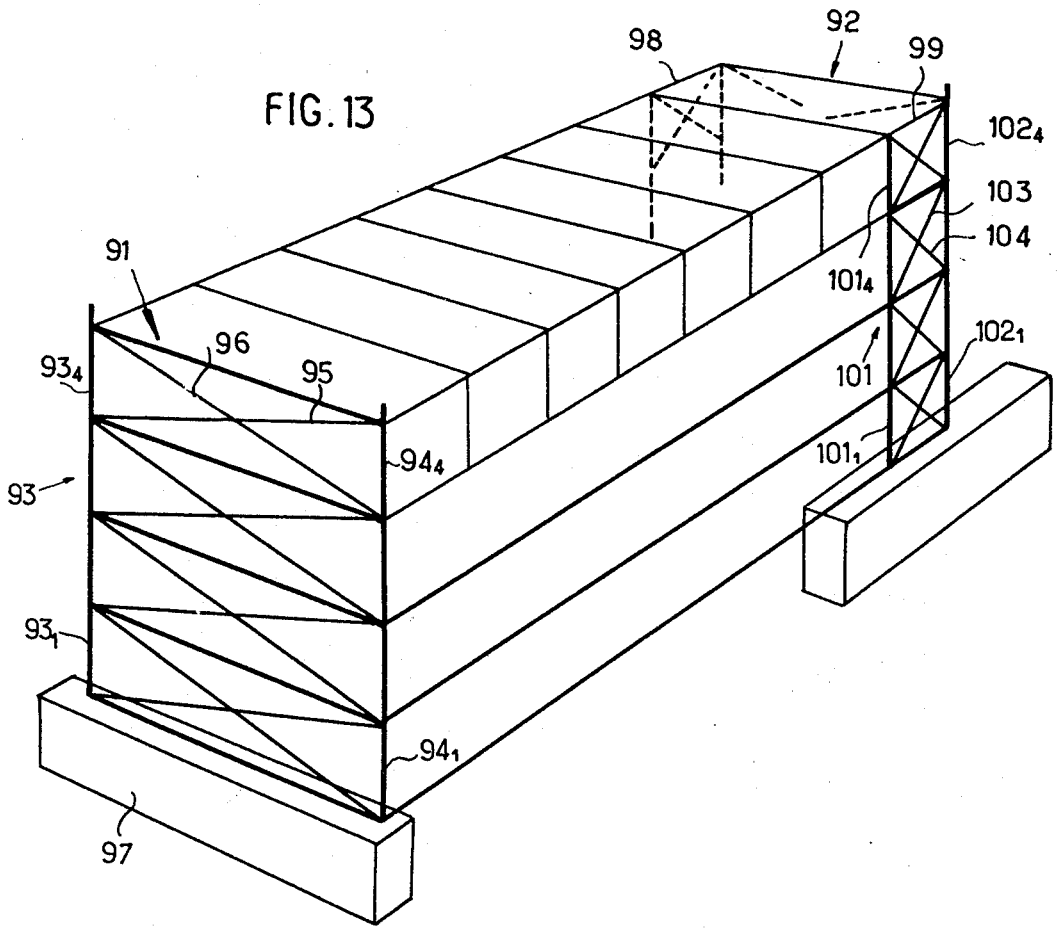
FIG. 13 is a diagrammatical view of the structure of a building according to the invention.
Figure 14:
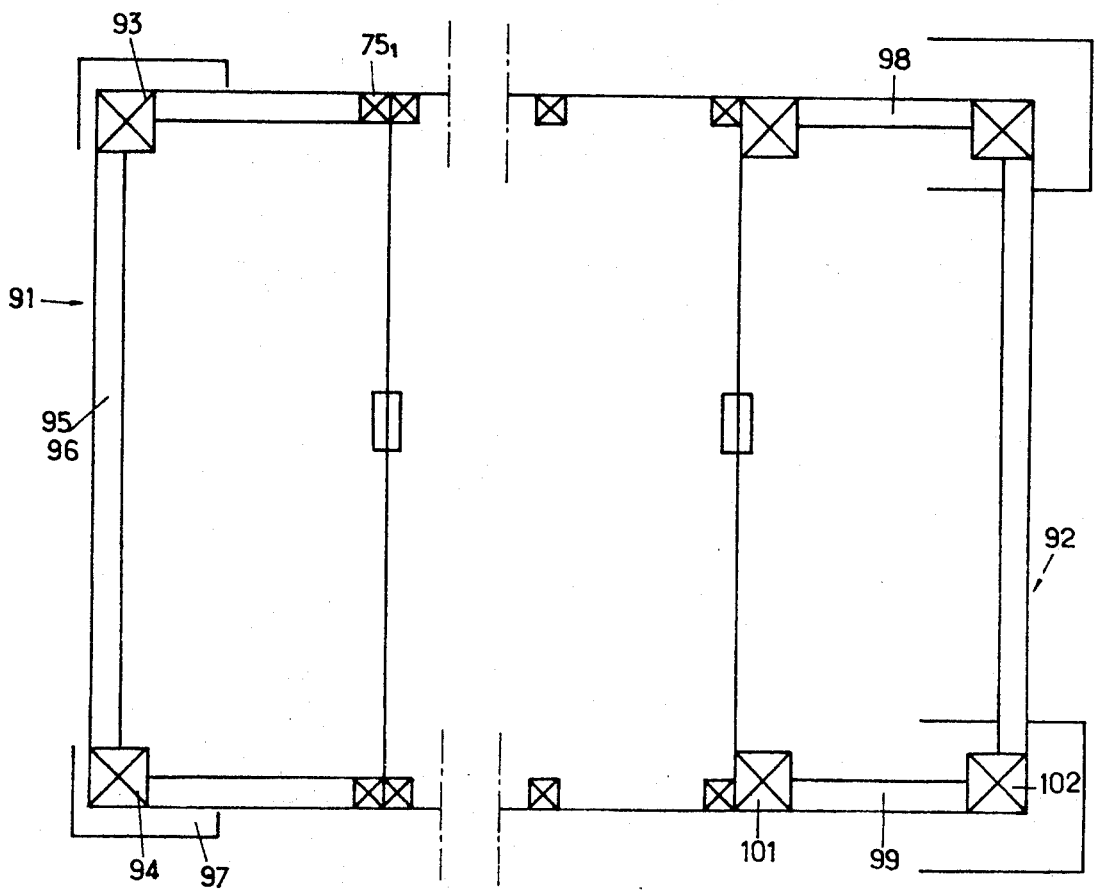
FIG. 14 is a top view of a multi-story building employing the building arrangement of FIG. 13.

All the horizontal stresses applied to one of the fronts of a building comprising several stories each constituted by one or more rows of units of the invention, as represented in FIG. 13, can thus be transmitted without difficulty to piles as represented at 91 and 92 in the longitudinal direction which comprises vertical framework elements 93 and 94 resulting from the assembling of columns of end units $93_1$–$93_4$, $94_1$–$94_4$, respectively, which are, if necessary, stronger than the columns of a standard unit of the invention, together with diagonal elements 95–96 and so on down to foundations 97, in accordance with a principle used in metallic construction. The horizontal stresses applied to the ends of the building are similarly transmitted to piles 98 and 99 at right angles to piles 91 and 92, which themselves include vertical framework elements 101 and 102 constituted by superposing columns $101_1$–$101_4$ and $102_1$–$102_4$ of the end units and which are, if necessary, stronger than the ordinary columns of the units of the invention, and diagonal elements 103 and 104 which finally transmit the stresses to the foundations. The greater strength of columns 93-94-101-102 may result from larger external dimensions of the tubular element as shown in FIG. 14, a greater wall thickness of the tubular elements, or else a greater wall thickness and increased dimensions.

It is thus possible to construct multi-story buildings constituted by assembling light-3-dimensional or volumic elements which are transportable and cheap, each story comprising a bracing unit obtained by means of the different juxtaposed slabs of the different units inter-assembled as above indicated, so as to make it possible to transmit the horizontal stresses to a small number of vertical piles, which transmit the load of said horizontal stresses to the foundations, the whole of the building thus having sufficient resistance to withstand the most violent winds and, if the case arises, earth tremors, the entire construction being, nonetheless, light and cheap.

As the vertical panels of the units do not contribute to wind bracing, it is possible, by juxtaposing elements according to the invention, not fitted with vertical panels, to provide inside the buildings rooms or halls whose dimensions are practically unlimited. This gives the architect the greatest possible freedom as regards designing a dwelling or utility building.

While the invention has been disclosed with reference to a limited number of embodiments, it will be apparent that variations may be made therein, and it is intended in the following claims to cover each such variation and modification as falls within the true spirit and scope of the invention.

What is claimed is:

1. A unitary construction element to build a multi-story structure comprising a rectangular slab made of unprestressed concrete with a relatively thin slab body having longitudinal and transverse edge ribs, a rectangular notch with two perpendicular vertical faces at each of the corners of the slab, a metallic facing on said two faces, and integral with said slab, whereby said metallic facings define rectangular cut-outs at each corner of said slab, said facings having heights substantially equal to the heights of the adjacent ribs of said slab, and a vertical tubular column having a rectangular cross section, planar faces and a height equal to that of a story of said structure at each corner of said slab, the bottom of said columns being housed in the respective notch and bound to the slab by welding two planar faces directly to the respective opposed metallic facing, the remaining faces of said columns extending in the planes of the perpendicular edges of the slab.

2. A construction element according to claim 1, wherein a transverse rib connects to the middle of the longitudinal edge ribs.

3. A construction element according to claim 1, wherein internal metallic plates are integral with the metallic facings and are embedded in the concrete of the slab body.

4. A construction element according to claim 3, wherein anchoring irons are integral with the metallic plates.

5. A construction element according to claim 1, wherein the metallic facings extend over a portion of the external faces of the ribs.

6. A construction element according to claim 1, wherein the longitudinal ribs are provided halfway between their ends with a recess in their upper face and an adjoining recess in their vertical face.

7. A set of two construction elements according to claim 1, wherein the columns of two adjacent elements are adjacent each other, comprising means for binding said columns together.

8. A set of two elements according to claim 6, comprising two corner plates housed in the recesses of the longitudinal ribs and adjacent each other, said plates being welded to each other.

9. The construction element according to claim 1 wherein said tubular column is contained within a rectangular envelope defined by the planes of the said perpendicular edges of said slab.

10. A multi-story structure comprising a plurality of substantially rectangular parallepiped construction units and a framework adapted to rest on a foundation, each of said construction units comprising a rectangular slab of un-prestressed concrete with a relatively thin slab body having longitudinal and transverse edge ribs, a rectangular notch with two perpendicular vertical faces at each of the corners of the slab, a metallic facing on said two faces and integral with said slab, whereby said metallic facings define rectangular notches at each corner of said slab, and a vertical tubular column having a rectangular cross section, planar faces and a height equal to that of a story of said building at each corner of each slab, the bottom of each said columns being housed in the respective notch of the slabs and bound to the slabs by welding two planar faces directly to the respective opposed metallic facing, the remaining faces of the columns constituting extensions of and being in the planes of said perpendicular edges of the respective slab, said construction units being arranged to form a plurality of stories, with each story being comprised of a plurality of construction units with their slabs juxtaposed, the columns of the construction units of each story being vertically supported by the columns of the construction units of stories thereunder, a plurality of the columns of terminal units of said structure being reinforced, said framework comprising said reinforced columns of the terminal units of the stories, and diagonal cross bracing between said reinforced columns, whereby horizontal stresses on said building are transmitted from said slabs to said framework, and thence to a foundation supporting said building.

11. The structure of claim 10 comprising internal metallic members integral with said metallic facings and embedded in the concrete of the respective slab body.

12. The structure of claim 10 wherein said metallic facings extend over a portion of the external faces of said ribs of each said slab.

13. The structure of claim 10 wherein the longitudinal ribs of each rectangular slab are provided between their ends with a recess in their upper face and an adjoining recess in their vertical face, an angle iron means in said recesses, with the angle iron means of adjacent rectangular slabs of each story being affixed together.

14. The structure of claim 10 wherein the tubular columns are contained within the rectangular envelopes defined by the planes of said perpendicular edges of the respective slabs.

15. The structure of claim 10, wherein said reinforced columns of said terminal units have greater strength than the columns of other units.

16. The structure of claim 10, wherein the external dimensions of said reinforced columns, in cross section, are greater than the cross-sectional dimensions of the columns of other said units.

17. The structure of claim 10, wherein the wall thicknesses of said reinforced columns are greater than the wall thicknesses of the columns of other said units.

* * * * *